US005288372A

United States Patent [19]

Baker et al.

[11] Patent Number: 5,288,372

[45] Date of Patent: Feb. 22, 1994

[54] ALTERING A METAL BODY SURFACE

[75] Inventors: Bernard R. Baker, Golden; Eugene A. Beck, Broomfield, both of Colo.

[73] Assignee: Alumax Inc., Norcross, Ga.

[21] Appl. No.: 909,637

[22] Filed: Jul. 7, 1992

[51] Int. Cl.[5] ..... C25D 11/02

[52] U.S. Cl. ..... 204/129.1; 205/153; 205/175; 205/214

[58] Field of Search ..... 204/129.4; 205/153, 205/175, 214

[56] References Cited

U.S. PATENT DOCUMENTS

| | | | |
|---|---|---|---|
| 3,031,387 | 4/1962 | Deal et al. | 204/58 |
| 3,252,875 | 5/1966 | Economy | 204/58 |
| 3,328,274 | 6/1967 | Bushey et al. | 204/58 |
| 3,616,311 | 10/1971 | Barkman et al. | 204/58 |
| 3,634,208 | 1/1972 | Kuroda | 204/35 N |
| 3,661,729 | 5/1972 | Miyakawa et al. | 204/35 N |
| 3,714,001 | 1/1973 | Dorsey | 204/58 |
| 3,834,998 | 9/1974 | Watanabe et al. | 204/33 |
| 3,836,439 | 9/1974 | Ikegaya et al. | 204/58 |
| 3,887,447 | 6/1975 | Sheasby et al. | 204/129.4 |
| 3,963,594 | 6/1976 | Brasko | 204/129.95 |
| 4,072,589 | 2/1978 | Golda et al. | 204/129.4 |
| 4,152,222 | 1/1979 | Sheasby et al. | 204/35 |
| 4,172,772 | 10/1979 | Ould et al. | 204/129.85 |
| 4,502,925 | 3/1985 | Walls | 205/214 |
| 4,915,800 | 4/1990 | Nakanishi et al. | 204/35.1 |

FOREIGN PATENT DOCUMENTS

| | | | |
|---|---|---|---|
| 54-53639 | 4/1979 | Japan | C25D 11/04 |
| 1027695 | 4/1966 | United Kingdom . | |
| 1344192 | 2/1974 | United Kingdom | C23B9 02 |

OTHER PUBLICATIONS

E. P. Short, "Brief Review of the Technology of Architectural Anodizing" Aluminum Industries, Mar. 1988, 7(3), pp. 19-25.

*Primary Examiner*—John Niebling
*Assistant Examiner*—Patrick J. Igoe
*Attorney, Agent, or Firm*—Sheridan Ross & McIntosh

[57] ABSTRACT

A method for changing a metal body, especially an aluminum alloy body, and, in particular, a method for producing a uniform metal body surface for use in achieving desired light reflectance characteristics and/or other useful attributes. The method comprises (a) preparing a metal body in a first solution by producing a first coating on at least a desired portion thereof with the first coating providing a substantially continuous outer surface on the metal body and (b) treating the metal body to achieve substantial uniformity throughout the desired portion of the metal body. In the treating step, substantially all of the first coating is removed in a second solution. The metal body has a substantially uniform roughened surface after the treating step which is sufficient to substantially optimize diffusive reflectance and reduce spectral reflectance of the metal body surface. The preparing step is preferably accomplished by anodizing. The treating step is preferably accomplished by electroetching, etching, and anodizing in that sequence. The final shade of gray of the second coating after the last anodizing step is determined by the contacting time in the etch step and the voltage or current in the last anodizing step. The invention has many attendant advantages including metal body surfaces that have substantially uniform roughness with the surface texture being reproducible.

35 Claims, 2 Drawing Sheets

ALTERING A METAL BODY SURFACE

I. FIELD OF THE INVENTION

The present invention relates to a method for changing a metal body and, in particular, to a method for producing a uniform metal body surface for use in achieving desired light reflectance characteristics and/or other useful attributes.

II. BACKGROUND OF THE INVENTION

In various industries it is necessary to produce a metal body having a surface with uniform roughness characteristics. In construction, architecture and special purpose applications, for example, it is desired that metal bodies used as window and door frames, railings, curtain walls, and light standards, among other things, include decorative and protective coatings having a smooth, flat, low-gloss, enamel-like finishes that do not have a metallic sheen. Such a metallic sheen results from the light reflective characteristics of the surface which are in turn dependent upon the surface's degree of roughness. It is also desirable to produce protective coatings having such finishes that are not only clear and colorless but also in a variety of colors, including white, gray, bronze, black, red and gold. In lithography, it is desirable that metal body surfaces uniformly have a desired degree of roughness to enable ink or other decorative coatings or finishes to adhere to desired portions of the metal body.

One approach to produce metal bodies with protective and decorative coatings for construction, architecture and special purpose applications is to paint the metal body, which hides the metallic appearance of the coating. Painted aluminum, while performing satisfactorily for many years, does not have the service life, especially in outdoor exposure, that anodized aluminum does. Because the appearance of painted aluminum is popular with architects, and because there is a need to have coatings with a longer service life than paints, it is desirable to develop a protective coating that has the appearance of a painted finish but has the long-term protective quality of protective coatings formed by anodizing. As used herein, anodize refers to a process wherein a metal body is electrochemically treated to produce a coating on the metal body's surface.

Another approach to produce protective and decorative coatings is to produce oxidized coatings by anodizing the metal body. The first step in this process is a chemical etch step to roughen the surface of the metal body before the coating is applied. The etch step is commonly done using a solution containing 50 to 60 grams per liter of caustic soda at 55° to 65° C. The metal body is immersed for 10 to 12 minutes in the etch solution during which time aluminum is dissolved from the surface. The etch typically produces a metal body surface with a pit diameter of 5 to 20 microns and a depth less than 1 micron. When the desired amount of aluminum is removed, the metal body is de-smutted, rinsed and anodized to produce the protective and decorative oxide coating.

This approach suffers from a series of problems. First, the etch step provides a metal body surface not uniformly having a desired degree of roughness. The surface often contains defects such as pit defects, plateau defects, and die lines which cause complications in later process steps. As a consequence, the light reflective characteristics of the metal body surface give the surface a metallic sheen. Second, the processes provide metal bodies with surface roughnesses that are difficult to reproduce. Accordingly in manufacturing operations, the final products do not have uniform color characteristics. Third, the processes require high current densities and voltages. The processes also require temperatures of the electrolytic bath that are so low that they typically require chilling of the bath. Accordingly, the coatings are expensive to produce.

There are numerous processes to provide oxide coatings in desired colors. One process is disclosed in U.S. Pat. No. 3,031,387 to Deal et al., U.S. Pat. No. 3,328,274 to Bushey et al., and United Kingdom Patent No. 1,344,192. U.S. Pat. No. 3,031,387 discloses a process in which the metal body is chemically etched in a sodium hydroxide and sodium fluoride solution and subsequently anodized in an electrolyte consisting of sulfosalicylic acid and at least one substance selected from the group consisting of metal sulfates and sulfuric acid. U.S. Pat. No. 3,328,274 discloses a process in which the metal body is anodized under constant current density and then, when a certain pre-selected voltage is reached, under constant voltage. United Kingdom 1,344,192 discloses a process to control the color of the coating by developing a voltage-time relationship for a given bath composition and temperature and for a particular metal body composition. These processes produce coatings in a variety of colors including gray, bronze, and black. The processes not only require high power requirements but also are extremely sensitive to the composition of the metal body.

Another process uses an oxalic acid solution containing dissolved titanium in the electrolysis step to produce a white coating. Although the coatings produced by this process are white and opaque, the anodizing bath is difficult to maintain and the process hard to control. Consequently, the coatings are not only expensive to produce but also do not uniformly have desired color characteristics. This lack of uniformity exists not only for a given metal body but also among a series of metal bodies subjected to the process.

The lithographic industry by contrast employs an electroetch step and an etch step to provide a roughened metal body surface. U.S. Pat. No. 3,963,594, for example, discloses a process in which aluminum bodies are electrolytically treated under alternating current in an aqueous solution of hydrochloric acid and gluconic acid. The aluminum bodies are thereafter etched in a sodium hydroxide solution at room temperature. Similarly, United Kingdom Patent 1,027,695 discloses a process in which the electroetch step is followed by a brief electrolysis step under direct current to apply a coating to the aluminum body typically having a thickness of from 1 to 2 microns.

These processes also suffer from a series of drawbacks. First, the combined electroetch and etch steps provide a metal body surface not having a uniform degree of roughness. The surface often contains defects which cause complications in later processing. Second, the processes provide metal bodies with surface roughnesses that are difficult to reproduce. Accordingly in manufacturing operations, the final products do not have uniform roughness characteristics.

In view of the above, a need exists for a new method for providing metal bodies having surfaces with a uniform degree of roughness, for the reproducing such surface characteristics, and producing protective and decorative coatings of different colors that have smooth, flat, lowgloss, enamel-like finishes.

III. SUMMARY OF THE INVENTION

The present invention includes a method for altering a metal body and a metal product produced by that method. The method is particularly suited for altering aluminum and aluminum alloy bodies. In one embodiment, the method comprises (a) preparing a metal body in a first solution by producing a first coating on at least a desired portion thereof with the first coating providing a substantially continuous outer surface on the metal body and (b) treating the metal body to achieve substantial uniformity throughout the desired portion of the metal body. The treating step includes removing substantially all of the first coating from the metal body in a second solution. The thickness of the first coating is at least about 100 angstroms and ranges from about 100 to about 1,000 angstroms. The first coating has a large number of uniformly distributed pores which define a pore density of at least about $1\times10^{10}$ pores/cm$^2$ and ranges from about $1\times10^{10}$ to about $1\times10^{11}$ pores/cm$^2$.

The metal body has a substantially uniform roughened surface after the treating step. The degree of roughness of the metal body surface is sufficient to substantially optimize the diffusive reflectance of the metal body and reduce the spectral reflectance of the metal body surface after the treating step. As used herein, reflectance refers to the reflective properties of a surface for electromagnetic radiation, usually light. Spectral reflectance is the radiant reflectance for a specified wavelength of the incident radiation flux. Radiant reflectance is the ratio of the reflected radiant flux to the incident radiant flux. Diffusive reflectance is the ratio of the nonreflected radiant flux to the incident radiant flux for a specified wavelength of the incident radiant flux.

In one aspect of the present invention, the first solution comprises an electrolyte and the preparing step comprises contacting the metal body with electric current. The concentration of the electrolyte depends upon the composition of the electrolyte, the susceptibility of the metal body to chemical attack by the electrolyte, the chemical composition of the metal body, the temperature utilized and the voltage or current applied. The thickness of the coating depends upon the time associated with the preparing step, the thickness of the metal body, the composition of the metal body and the current or voltage applied.

In another aspect of the present invention, the treating step includes the electrochemical treatment of the metal body using alternating current in a second solution to remove metal from the desired portion of the metal body. As used herein, alternating current refers to an electrical current having a cyclic positive and negative waveform. Following electrochemical treatment, the treating step may include contacting the metal body contacted with a third solution for a predetermined time to produce a roughened surface on the desired portion of the metal body. After contacting the metal body with the solution, the treating step may include electrochemically treating the metal body with a fourth solution comprising an electrolyte at a predetermined voltage to produce a second coating having substantially uniform light reflectance throughout the desired portion of the metal body. During the treating step, about 1,000 times more metal is removed than any metal removed during the preparing step.

Surprisingly, the predetermined time of contacting the metal body with the third solution and the electrical parameters used in the electrochemical treatment of the metal body in the fourth solution, such as the predetermined voltage, determine the shade of gray of the second coating. Longer contacting times produce a lighter shade of gray and shorter contacting times produce a darker shade of gray. Higher voltages produce a darker shade of gray and lower voltages produce a lighter shade of gray. The present invention provides metal products having surfaces with a uniform degree of roughness, a method enabling such surface characteristics to be reproduced, and metal products having protective and decorative coatings of different colors that have a smooth, flat, low-gloss, enamel-like finishes. As a result, the present invention provides metal products with superior light reflectance characteristics and other useful attributes.

IV. BRIEF DESCRIPTION OF THE DRAWINGS

V. DETAILED DESCRIPTION OF THE INVENTION

The method of the present invention is suitable for forming a metal body surface having desired roughness characteristics. One notable and specific use of the method of the present invention is to produce a coating on the metal body surface having desired color and light reflectance characteristics by the addition of an anodizing step. The light reflectance characteristics of the coating result from the contact of the substantially uniform, roughened surface of the metal body with the coating. The degree of roughness of the metal body surface is sufficient to reduce the spectral reflectance and substantially optimize the diffusive reflectance of the surface and therefore the coating. The metal body surface thereby causes the coating to have a smooth, flat, low-gloss, enamel-like finish that does not have a metal sheen. A pigment may be incorporated into the solution used to form the coating to further influence the coating's light reflective characteristics to produce a coating of desired colors other than shades of gray.

The metal body may be composed of any aluminum or any suitable aluminum alloy that is capable of forming a coating. The preferred aluminum alloys are 6061 and 6063. The metal body may be of any desired shape, including but not limited to metal films, foils, plates, sheets, continuous webs, etc. Such metal bodies have a myriad of uses, including without limitation lithography, window and door frames, railings, curtain wall, light standards, cars, airplanes, railroad cars, road signs, metal components used in high technology industries, computer and calculator face plates, etc.

Figure 1:
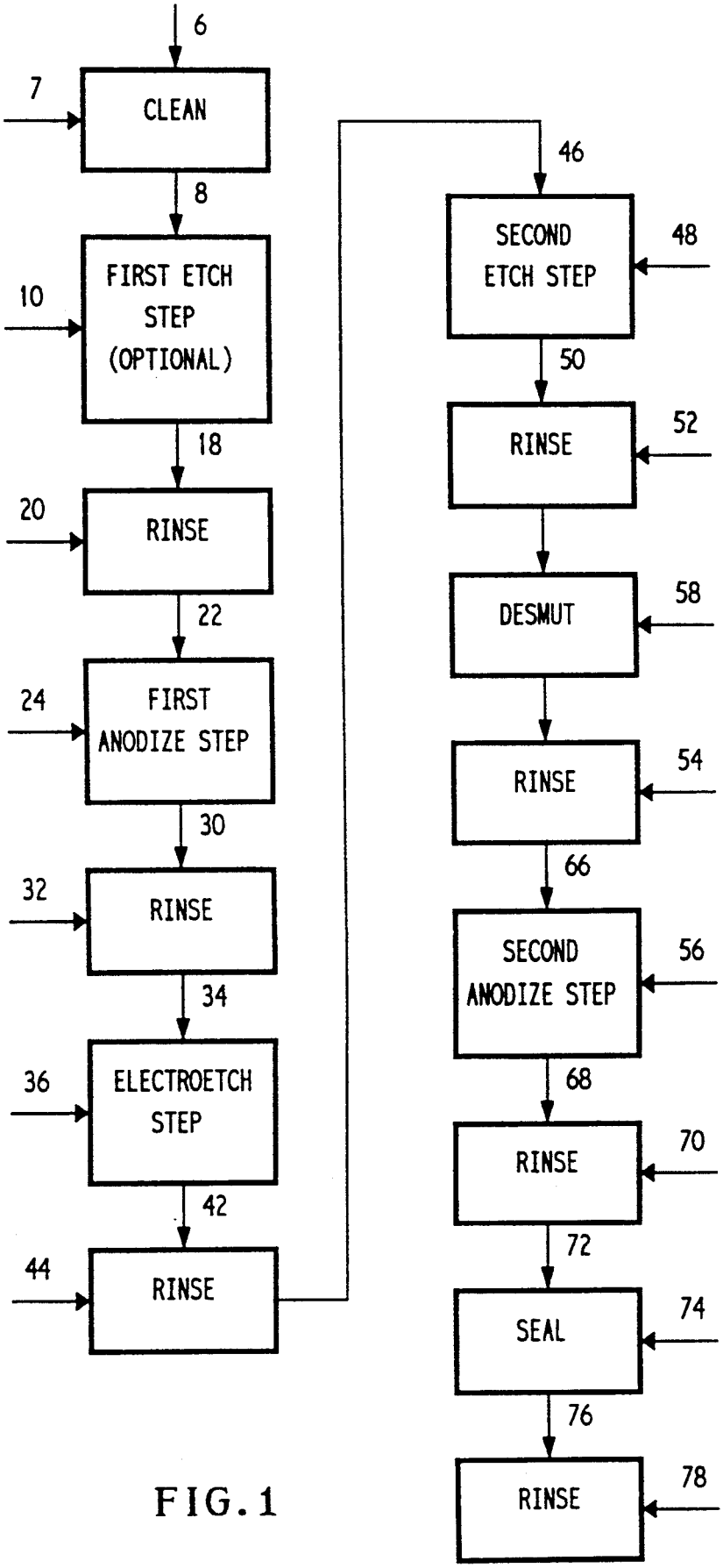
FIG. 1 is a schematic flow diagram showing a preferred embodiment of the method for forming a second coating of a desired color and light reflectance characteristics on a metal body.

Referring to FIG. 1, an embodiment of the invention, a metal body 6 is contacted with any conventional mildly alkaline cleaner 7 to remove foreign material such as oils, soils and oxide films, which typically have a thickness of 20 to 50 angstroms, from the surface of the metal body 6 without attacking the metal body 6. The metal body 6 may be contacted with the alkaline cleaner 7 by spraying the alkaline cleaner 7 onto the metal body's surface, by immersing the surface of the metal body 6 in the alkaline cleaner 7, or by any other suitable means.

In an optional first etch step, the metal body 8 may be contacted with a solution 10. The solution 10 substantially removes the outer layer of metal from the metal body 8 to remove oxide inclusions and other debris from the metal body surface, levels die lines and other asperites on the metal body's surface, and produces a matte surface. The use of the first etch step in the present invention was found to increase substantially the amount of aluminum oxide waste while providing little benefit to the process. Accordingly, the first etch step increases production costs with no significant offsetting benefits. It has been unexpectedly found that a second etch step as discussed below more effectively and economically accomplishes each of the foregoing objectives.

The solution 10 is typically about a five percent by weight sodium hydroxide solution which is contacted with the metal body 8 for about ten minutes at about 50° to about 60° C. As will be known and understood by those skilled in the art, the outer layer of metal may also be removed by mechanical means such as wire brushing, flap brushing, sand blasting, or aqua blasting techniques.

In one aspect of the present invention a metal body is prepared in a first solution by producing on at least a desired portion of the metal body's surface a first coating that provides a substantially continuous outer surface on the metal body for use in later achieving substantial uniformity throughout the desired portion. Preferably, the substantially uniform characteristic is the roughness of the metal body surface. The solution preferably comprises an electrolyte and the preparing step preferably comprises contacting the metal body with electric current.

Figure 2:
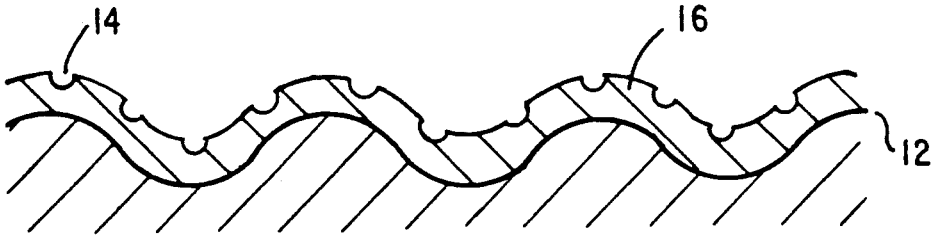
FIG. 2 is a cross-sectional view of the metal body after the preparing step showing the first coating and the metal body.

It has been unexpectedly found that this step substantially improves the uniformity and reproducibility of the roughness of the metal body surface. In other words, the first coating was found to substantially optimize the diffusive reflectance and reduce the spectral reflectance of the metal body surface after the treating step, as described in detail below. While not wishing to be bound by any theory, as shown in FIG. 2, the improved uniformity and reproducibility of the roughness of the metal body surface 12 may be the result of the high population density of substantially uniformly distributed pores 14 in the coating 16 produced in this step. The population density preferably ranges from about $1\times10^{10}$ to about $1\times10^{11}$ pores/cm$^2$. The diameter of the pores preferably ranges from about 75 to about 200 angstroms. These pores 14 may direct the attack during the initial stages of the treating step to roughen the metal body surface 12 uniformly over the metal body surface 12 to produce a fine matte etch, rather than a more coarsely etched surface that would result from a more localized attack on a bare surface.

Referring to FIGS. 1 and 2, after the metal body 18 is rinsed with water 20, the metal body 22 is anodized in a first anodizing step to produce first coating 16 on the metal body surface 12. The anodizing may employ direct current, alternating current, pulsed current, a combination of direct and alternating current, or a current with a waveform having the same effect as direct or alternating current. As used herein, direct current refers to an electrical current having a noncyclic waveform. Direct current is preferred as it enables more effective process control.

The first anodizing step occurs in a first solution 24 consisting of one or more electrolytes. As used herein, electrolyte refers to a solid or liquid substance that provides ionic conductivity when dissolved in water or contacted with water. The electrolyte is preferably sulfuric acid, oxalic acid, chromic acid, phosphoric acid, or mixtures thereof. The concentration of electrolyte depends upon a number of factors, including but not limited to the identity of the electrolyte, susceptibility of the metal body 22 to chemical attack by the electrolyte, the voltage, current, and temperature employed, and the chemical composition of the metal body 22. The most preferred electrolyte is sulfuric acid which preferably has a concentration of about 10 to about 18 wt. %, more preferably about 14 to about 16 wt. % and most preferably about 15.5 to about 16 wt. %.

The first anodizing step is performed at a voltage and current density for a time and at a temperature sufficient to produce a first coating 16 on the metal body surface 12 preferably ranging from about 100 to about 1000 angstroms, more preferably from about 150 to about 200 angstroms, and most preferably from about 180 to about 200 angstroms in thickness. The coating thickness is a function of the anodizing time, the thickness of the metal body 22, the composition of the metal body 22, the temperature and identity of the electrolyte, and the current and voltage. For aluminum alloys, the electrolysis is preferably performed at about 10 to about 20 volts dc at current densities ranging from about 6 to about 20 amp/ft$^2$, more preferably from about 12 to about 18 volts dc at current densities ranging from about 9 to about 18 amp/ft$^2$, and most preferably from about 15 to about 18 volts dc at current densities ranging from about 12 to about 15 amp/ft$^2$. Based on the foregoing, the anodizing time is preferably about 30 to about 90 seconds, more preferably about 30 to about 60 seconds, and most preferably about 45 to about 60 seconds at ambient temperature. As used herein, ambient temperature refers to a temperature between about 18° C. to about 25° C.

The electrolytic cell may be of any conventional design with the metal body 22 acting as the anode. The first solution 24 is vigorously agitated throughout electrolysis to ensure uniformity of acid concentration and temperature. Temperature control of first solution 24 during anodizing is accomplished by any technique known in the art including water-cooled, immersed lead pipes and external heat exchangers.

Another aspect of the present invention includes a treating step in which substantially all of the first coating is removed in one or more solutions from the metal body to produce a substantially uniform roughened surface on a desired portion of the metal body. Preferably, the treating step includes contacting under alternating electric current the metal body with a second solution comprising an electrolyte to remove metal from the metal body.

Figure 3:
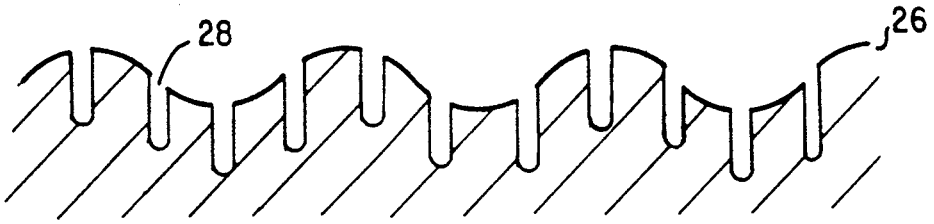
FIG. 3 is a cross-sectional view of the metal body after the electroetch portion of the treating step showing the pore structure of the metal body surface.

FIG. 3 illustrates the appearance of the metal body surface 26 after contacting the metal body under alternating current with a second solution comprising an electrolyte. The metal body surface 26 contains a series of pits 28 substantially uniformly distributed over a desired portion of the metal body surface 26. The pit density preferably ranges from about $1\times10^6$ to about $1\times10^7$ pits/cm$^2$. Pit diameter preferably ranges from about $1\times10^{-4}$ to about $1\times10^{-3}$ cm. Pit depth preferably ranges from about 1 to about 3 microns.

Referring to FIG. 1, after the metal body 30 is rinsed with water 32 to substantially remove the electrolyte from the metal body surface, the metal body 34 is electroetched with second solution consisting of one or more electrolytes. As used herein, electroetch refers to a process wherein a metal body is electrochemically treated to remove metal from the metal body surface. The electrolyte is preferably hydrochloric acid, gluconic acid, nitric acid, boric acid, phosphoric acid and mixtures thereof. The concentration of electrolyte depends upon a number of factors, including but not limited to the identity of the electrolyte, susceptibility of the metal body 34 to chemical attack by the electrolyte, the voltage, current, and temperature employed, and the chemical composition of the metal body 34. The second solution 36 preferably has about 10 to about 40 grams per liter hydrochloric acid and about 2 to about 20 grams per liter gluconic acid, more preferably about 15 to about 36 grams per liter hydrochloric acid and about 5 to about 10 grams per liter gluconic acid, and most preferably about 18 to about 25 grams per liter hydrochloric acid and about 8 to about 10 grams per liter gluconic acid.

The electroetch is performed at a voltage and current density for a time and at a temperature sufficient to remove preferably about 0.1 to about 0.4 mils of metal. This amount of metal removed is about 1000 times more than is removed during the preparing step. The amount of metal removed is a function of the time, the thickness of the metal body 34, the composition of the metal body, the temperature and identity of the electrolyte, and the current and voltage. If too much metal is removed, the surface of the metal body will have a pit density less than about $1\times10^6$ pits/cm$^2$. If too little metal is removed, the surface of the metal body will have a pit density greater than about $1\times10^7$ pits/cm$^2$. In either case, the metal body surface will not possess, after the treating step, the desired spectral and diffusive reflectance.

For aluminum alloys, the electrolysis is preferably performed at about 1 to about 4 volts at a standard 60 hz a.c. current density of about 20 to about 40 amp/ft$^2$, more preferably from about 1 to about 2 volts at a standard 60 hz a.c. current density of about 25 to about 35 amp/ft$^2$, and most preferably from about 1.5 to about 2 volts at a standard 60 hz a.c. current density of about 25 to about 30 amp/ft$^2$. Based on the foregoing, the electrolysis time is preferably about 5 to about 20 minutes, more preferably about 7 to about 15 minutes, and most preferably about 10 to about 12 minutes, at temperatures from about 20° C. to about 40° C. The voltage and current density will vary as the electroetch proceeds. As the pits increase in size, the electrical resistance increases. Although direct current or combinations of direct and alternating current may be used, alternating current is preferred as it permits pits to have alternating cycles of growth and passivation. In this manner, alternating current produces a higher pit density than direct current.

The electroetch may be done in any suitable electrolytic cell of any conventional design. The metal body 34 is immersed in the second solution 36 and is used as an electrode. In a preferred embodiment, the metal body 34 is an electrode and graphite the counterelectrode. The second solution 36 is mildly agitated throughout the treatment to ensure uniformity of acid concentration and temperature. Temperature control of the second solution 36 may be by any technique known in the art including water-cooled, immersed lead pipes and external heat exchangers.

In another aspect of the present invention, the treating step may include contacting of the metal body after the prior metal removal step with a third solution for a predetermined time to produce a roughened surface on a desired portion of the metal body. Preferably, the third solution comprises a caustic compound. It has been unexpectedly found that the time of contacting the metal body with the third solution determines the shade of gray of the second coating discussed in detail below. Longer contacting times produce a lighter gray. Shorter contacting times produce a darker gray. While not wishing to be bound by any theory, the relationship between contacting time and shade of gray results from the fact that longer contacting times reduce the amount of mobile aluminum atoms and molecules contained in the second coating after the completion of the treating step. It is believed that the gray appearance of the second coating is caused by the presence of aluminum atoms and molecules in the second coating. Mobile aluminum atoms and molecules are those contained in sharp edges and ridges formed by surface irregularities such as pits. Longer contacting times round off such edges and ridges.

Figure 4:
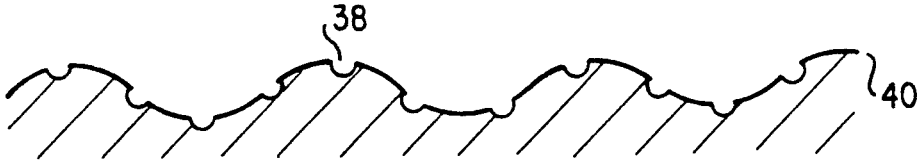
FIG. 4 is a cross-sectional view of the metal body after the etch portion of the treating step showing the pore structure of the metal body surface.

FIG. 4 illustrates the surface of the metal body after contacting the metal body with the third solution for a predetermined time. Referring to FIGS. 3 and 4, only a portion of the pits 38 remain after contacting. The size and density of the pits 38 following contacting is the same as that after electroetching. If too much metal is removed, the surface 40 of the metal body will be too smooth to produce the desired degree of roughness. Conversely, if too little metal is removed the surface 40 of the metal body will be too rough. In either case, the metal body surface 40 will not possess, after the treating step, the desired spectral and diffusive reflectance.

Referring to FIG. 1, following electroetching, the metal body 42 is rinsed with water 44 and the rinsed metal body 46 is contacted with third solution 48 comprising a caustic compound and water in a second etch step. The time of contacting is sufficient to remove preferably about 0.2 to about 1.0 mils of metal. The amount of metal removed is a function of the time, the thickness of the metal body 46, the composition of the metal body 46, the concentration of the caustic compound, and the temperature of the caustic solution. In the treating step, the total amount of metal removed is preferably from about 0.3 to about 1.4 mils of metal which substantially exceeds the thickness of the first coating in the preparing step. In other words, in the treating step the first coating from the preparing step is almost entirely, if not, entirely removed.

As stated above, the caustic compound may be any substance which removes metal and other contaminants from the surface of the metal body 46. Preferably, the caustic compound is sodium hydroxide, potassium hydroxide, sodium phosphate, sodium carbonate, and mixtures thereof. For aluminum alloys, the third solution 48 is preferably between about 5 and about 7 wt. % sodium hydroxide and between about 0.1 and about 0.02 wt. % sodium gluconate. The temperature of the third solution 48 is preferably ambient temperature.

Surprisingly, longer contacting times produce a lighter, blue-gray and shorter contacting times produce a darker, more distinct gray second coating. The contacting time required to produce a desired shade of gray is dependent upon the composition of the metal body 46, the temperature of the third solution 48 during contacting and the identity and concentrations of caustic compound in the solution 48. For aluminum alloys and the preferred third solution 48 at ambient temperature, the relationship between contacting time and shade of gray is shown in Table 1 below. A contacting time from about 0.5 to about 2 minutes produces a darker, more distinct gray second coating and a contacting time from about 2 to about 5 minutes produces a lighter, blue-gray second coating. In Example 1, for example, the aluminum coupon was immersed for 30 seconds in an ambient temperature caustic solution containing 60 grams/liter sodium hydroxide and 1% by weight sodium gluconate to produce a medium dark gray coating. In Example 2, by contrast, an identically prepared aluminum coupon was immersed for 60 seconds in the same caustic solution to produce a lighter gray coating than in Example 1.

As stated above, the use of a caustic compound substantially removes the outer layer of metal and contaminants, such as oxide inclusions, substantially levels die lines and other asperites, and produces a matte surface. Surprisingly, this etch step may be done at ambient temperature and is about 3 to 5 times as active towards an aluminum metal body 46 as the same etch without electroetching. About one-third of the aluminum removed in the combined electroetch and second etch steps is removed by the electroetch and about two-thirds by the second etch step. While not wishing to be bound by any particular theory, the electroetching apparently activates the surface of the metal body 46 to such an extent that the subsequent second etch step proceeds much more rapidly than without the electroetching and can proceed at satisfactory rates even at ambient temperatures.

Surprisingly, the combination of electroetching and second etch steps were more effective than conventional processes employing an etch using a caustic compound at elevated temperatures. First, the combined electroetch and second etch steps produces a metal body surface that is substantially more matte than that produced by an etch at elevated temperature without electroetching. This matte, or microscopically rough surface, then anodizes to form a substantially matte gray film, rather than the substantially clear, transparent film produced by an etch at elevated temperature alone. Second, the leveling of die lines and other surface defects by the combined electroetch and second etch steps is substantially greater than by the use of an etch at elevated temperature without electroetching. Gross surface deformities tend to be reproduced by the etch at elevated temperature without electroetching, rather than substantially leveled as in the present invention.

Following the second etch step, the metal body 50 is rinsed with water 52, de-smutted, and rinsed with water 54 a second time. The use of hydrochloric acid as an electrolyte in electroetching may cause problems in the second anodizing step described below. Chloride concentrations over about 200 ppm causes pitting in the second coating after the treating step. Chloride replaces the aluminum oxide on the metal body and provides a charged surface for reaction with the electrolyte in later parts of the treating step. Although there are numerous conventional techniques to apply rinsing solutions 52 and 54, it has been found that the use of counter current flowing rinses produces chloride concentrations in the solution 56 substantially below 200 ppm with a moderate flow of rinse water. De-smutting removes residual intermetalic compounds from the aluminum metal body that are insoluble in the solution 48. Any de-smutter 58 known in the art may be used, but non-chromated de-smutters are preferred.

In a further aspect of the present invention, the treating step may include electrochemically treating the metal body in a fourth solution at a predetermined voltage to produce a second coating on the metal body having substantially uniform light reflectance throughout a desired portion of the metal body. Preferably, the fourth solution comprises an electrolyte and the second coating is produced by contacting the metal body with electricity under direct current. Electrical parameters such as the current density and the predetermined voltage determine a desired shade of gray of the second coating. For example, higher voltages produce a darker, more distinct gray second coating. Lower voltages produce a lighter, blue-gray second coating. While not wishing to be bound by any theory, the relationship between electrical parameters and shade of gray results from the fact that higher voltages and current densities increase the amount of mobile aluminum atoms and molecules contained in the second coating after the treating step. It is believed that the gray appearance of the second coating is caused by the presence of aluminum atoms and molecules in the second coating.

Figure 5:
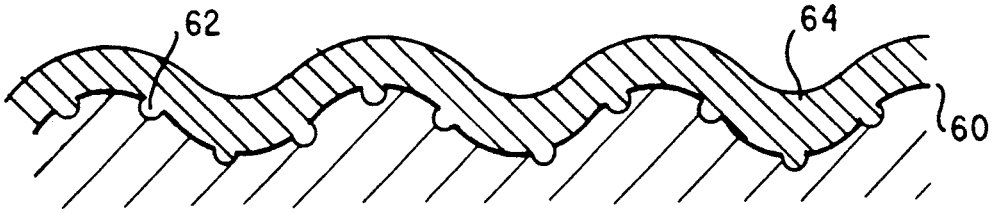
FIG. 5 is a cross-sectional view of the metal body after the final anodizing step showing the second coating and the pore structure of the metal body surface.

FIG. 5 illustrates the surface of the metal body after the second coating is applied. Referring to FIG. 5, the metal body surface 60 has a density of pits 62 that is the same as that following the electroetch step. As stated above, the roughened metal body surface 60 is sufficient to substantially optimize diffusive reflectance and reduce spectral reflectance. The surface 60 thereby causes the coating 64 to have a smooth, flat, low-gloss, enamel-like finish that does not have a metal sheen. The thickness of the second coating 64 preferably ranges from about 5 to about 30 microns, more preferably from about 7 to about 25 microns, and most preferably from about 10 to about 25 microns in thickness.

Referring to FIG. 1, the metal body 66 is immersed in fourth solution 56 containing one or more electrolytes at ambient temperature. Fourth solution 56 may be the same solution as first solution 24 or a separate solution. The composition of fourth solution 56 and the design of the electrolytic cell are the same as those set forth above in connection with the first anodizing step. The anodizing is typically conducted at a voltage and current and for a time sufficient to produce a second coating having the thicknesses described above. As stated earlier, the second coating thickness is a function of the anodizing time, the thickness of the metal body 66, the composition of the metal body 66, the temperature and identity of the electrolyte, and the current and voltage. For aluminum alloys, the electrolysis is preferably performed between about 10 to about 20 volts at current densities from about 10 to about 20 amp/ft$^2$, more preferably between about 12 to about 18 volts at current densities from about 11 to about 18 amp/ft$^2$, and most preferably between about 15 to about 18 volts at current densities from about 12 to about 16 amp/ft$^2$. Based on the foregoing, the anodizing time is preferably about 20 to about 80 minutes, more preferably about 30 to about 60 minutes and most preferably about 40 to about 50 minutes at ambient temperature.

Variations of the electrical parameters used in this step determines the shade of gray of the second coating. As stated above, a similar relationship exists between contacting time in the second etch step and the final shade of gray of the second coating. For a given contacting time, voltages ranging from about 18 to about 20 volts produce a darker, more distinct gray second coating and voltages ranging from about 12 to about 18 volts produce a lighter, blue-gray second coating. In Example 3, for example, the anodizing voltage ranged from 13 volts to 18 volts to produce a light blue-gray coating. In Example 4, by contrast, the anodizing voltage ranged from 15 volts to 24 volts to produce a darker gray coating.

The effect of the contacting time in the etch step and current density in the second anodizing step is demonstrated in Table 1. Color is expressed as L/a/b values where L is whiteness (100 is pure white), a is the green-red scale (− values are green, + values are red) and b is the blue-yellow scale (− values are blue, + values are yellow).

TABLE 1

| | Post Etch Time in Ambient Temp. 5% NaOH | | |
|---|---|---|---|
| Anodizing Current Density | 2 min. | 4 min. | 6 min. |
| 2 amp/ft$^2$ | 65.47/−<br>1.08/−0.13 | 71.5/−<br>1.08/+0.45 | 70.9/−<br>1.05/+1/38 |
| 8 amp/ft$^2$ | 66.3/−<br>1.05/+0.33 | 64.56/−<br>1.08/+1.10 | 71.12/−<br>1.04/+1.81 |

The relationship between current density and color is not observed here. This effect may exist in one alloy lot but not another; however, the occurrence of such effects may be substantially reduced by relatively minor variations in the present invention. The major effects of post-etch time are a higher L value (lighter gray) and an increase in yellowness (+ value of b) as the post-etch time increases.

In a further aspect of the present invention, a pigment may be included in solution 56 to provide a desired color to the second coating. In one notable and specific application, a pigment comprising titanium dioxide, may be included in solution 56 to produce a white second coating.

As will be known and understood by those skilled in the art, other conventional processes may also be used to produce a second coating of a desired color, including but not limited to hydro-thermal treatment of such coatings in phosphoric acid solution, a secondary electrolysis of the metal body in a transparent titanium hydroxide (IV) hydrosol, and immersion of the metal body in barium sulfate solution.

After the second anodizing step, metal body 68 may be rinsed with water 70, the rinsed metal body 72 sealed by a sealant 74 by any conventional technique, and the sealed metal body 76 rinsed a final time with water 78 to remove surface contaminants from the sealing process. Conventional sealing techniques include but are not limited to hydration of the coating, application of a solution of lanolin in white spirit to the coating, cold sealing, and lacquer sealing. The foregoing method of the present invention may be conducted in a batch, semi-continuous or continuous manner, as desired.

The present invention has several important advantages over the prior art. First, the present invention produces second coatings that have smooth, flat, low-gloss, enamellike finishes without the metallic sheen of prior art coatings. Second, the combined electroetch and second etch steps of the present invention level die lines and other raised surface defects to a substantially greater extent than prior art hot caustic etching techniques alone. Third, the present invention may produce second coatings having different shades of gray depending upon the contacting time in the second etch step and electrical parameters used in the second anodizing step. Fourth, the present invention provides a superior method to produce second coatings of various colors by using pigments in the anodizing solution. In particular, the white colored coatings of the present invention are superior to prior art techniques through the incorporation of a titanium-based pigment into the second coating. Fifth, the present invention offers a process which is environmentally sound and easily adaptable into existing anodizing manufacturing facilities. Sixth, the analysis of the electroetch solution is simplified for the reason that the hydrochloric acid, gluconic acid, and dissolved aluminum may be obtained in a single titration with sodium hydroxide solution to three different pH values. Seventh, the electroetch process has the potential of replacing conventional hot caustic etches for all anodizing processes. Such a replacement could result in savings of several thousands of dollars per year for each etch tank. The electroetch and second etch steps of the present invention offer the possibility of avoiding occasional spangle etch problems that occur due to zinc in the caustic etch solution, zinc in the alloy, excessive magnesium silicide precipitation in the alloy, or excessive alloy grain size. Eighth, the use of a first anodizing step before the electroetch step substantially improves the uniformity and reproducibility of the metal body surface(s) produced by the electroetch and second etch steps over prior art techniques. Ninth, the present invention is substantially less sensitive to variations in metal body composition from one alloy lot to the next compared to prior art processes. Finally, roughening the metal body surface by the combined electroetch and second etch steps has numerous applications besides the production of lithographic sheets and aluminum building materials. By way of example, such roughened surfaces may be useful for producing painted metal bodies by increasing the adhesion of paints to the metal body surface and in the pretreatment of metal bodies for adhesive bonding.

The following experimental results are provided for purposes of illustration and are not intended to limit the scope of the invention.

VI. EXPERIMENTS

A series of experiments simulating the steps of the processes of the present invention as depicted in FIG. 1 were performed. The metal bodies tested were 6063 alloys of aluminum, which is the aluminum alloy typically used in production of aluminum building materials. The experiments demonstrate the impact of variations of the contacting time in the second etch step and/or the voltage in the second anodizing step upon the final shade of gray of the metal body.

EXAMPLE 1

A 2×5-inch coupon of aluminum alloy 6063 was cleaned in a solution of McGean-Rohco Alkalume TM inhibited alkaline cleaner, rinsed in water and anodized for 30 seconds in 20° C. 15% sulfuric acid at 19 volts. The coupon was rinsed, immersed to a depth of 4 inches in a bath containing 30 grams per liter hydrochloric acid and 10 grams per liter gluconic acid at 30° C. Power was applied to the work using a variac as a power source for 60 hz a.c. The current was set at about 6 amps and the voltage required was about 4 volts a.c. After about 3 minutes, the voltage dropped and the current rose. The current was manually adjusted downward to 6 amps and 4 volts. After this adjustment, the current voltage stabilized at 6 amps and 4 volts, and the run was continued for a total of 10 minutes.

After rinsing in water, the coupon, which now had an iridescent red-green appearance, was immersed for 30 seconds in an ambient temperature solution containing 60 grams per liter sodium hydroxide and 1% sodium gluconate. The coupon was then rinsed in water, immersed for about 1 minute in 50% nitric acid, rinsed again in water then anodized for 30 minutes in 15% sulfuric acid at 20° C. and 18 amps per square foot (about 20 volts). The result was a medium dark gray, opaque coating about 0.6 mils thick.

EXAMPLE 2

A coupon of 6063 alloy was treated exactly as in Example 1, except that the time in the ambient temperature and second etch solution of sodium hydroxide was 60 seconds. The coating was a gray, opaque 0.6 mil thick coating slightly lighter than that of Example 1.

EXAMPLE 3

A coupon of 6063 alloy was cleaned, rinsed, and etched 10 minutes in a solution of 5% sodium hydroxide at 60° C., rinsed, de-smutted in 50% nitric acid, anodized for 90 seconds at 15 volts and 15% sulfuric acid at 20° C., rinsed then electroetched for 10 minutes. The electroetch was operated by applying 2 volts a.c. until the current rose to 5 amps, then the current was held for 10 minutes at 5 amps as the voltage dropped slowly to about 1.5 volts. The coupon was rinsed then etched in a 5% sodium hydroxide solution for 4 minutes at ambient temperature. Finally the coupon was rinsed and de-smutted in nitric acid for 2 minutes, rinsed and anodized at 12 amps per square foot for 45 minutes. During this time, the anodizing voltage rose from 13 volts to 18 volts. The coating was sealed in a conventional mid-temperature range nickel acetate sealing bath for 10 minutes. The color was measured on a Minolta Color Meter TM to give the values L=69.26, a=−1.21 and b=1.42. This coating was a very light blue-gray color, very flat and enamel-like.

EXAMPLE 4

A coupon of 6063 alloy was treated exactly as in Example 3, except the second etch time in ambient temperature sodium hydroxide was 1 minute, and the coupon was anodized at 18 amps per square foot for 30 minutes. The anodizing voltage rose during this period from about 15 volts to 24 volts. The color readings were L=60.10, a=−1.16, and b=0.89. The coating was much darker gray than that of Example 3.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. A method for altering a metal body, comprising:

(a) preparing a metal body in a first solution by producing electrochemically a first coating on at least a desired portion thereof, wherein said first coating has a large number of substantially uniformly distributed pores and provides a substantially continuous outer surface on said metal body; and (b) treating said metal body to achieve substantially throughout said desired portion of said metal body a substantially uniform distribution of pits and a substantially matte finish, said treating step including removing substantially all of said first coating from said metal body in a second solution, wherein a substantial number of said pits have a depth of no more than about 3 microns.

2. A method as claimed in claim 1, wherein said metal body comprises aluminum.

3. A method, as claimed in claim 1, wherein said metal body comprises aluminum having a substantially uniform roughened surface after said treating step.

4. A method, as claimed in claim 1, wherein said metal body comprises aluminum wherein the diffusive reflectance of said metal body is substantially optimized and the spectral reflectance of said metal body is reduced after said treating step.

5. A method, as claimed in claim 1, wherein said first solution comprises an electrolyte and the concentration of said electrolyte depends upon at least one of the following: the composition of the electrolyte, the susceptibility of said metal body to chemical attack by said electrolyte, the chemical composition of said metal body, the temperature utilized and the voltage or current applied.

6. A method, as claimed in claim 1, wherein said preparing step comprises producing electrochemically said first coating by anodizing said metal body to obtain a desired thickness of said first coating.

7. A method, as claimed in claim 6, wherein said desired thickness depends upon at least one of the following: the time associated with said anodizing step, the thickness of said metal body, the composition of said metal body and the current or voltage applied to said first solution.

8. A method, as claimed in claim 7, wherein said preparing step includes increasing the amount of at least a first electrical parameter applied to said first solution to obtain said desired thickness.

9. A method, as claimed in claim 1, wherein said treating step includes electrochemically treating said metal body using alternating current in a second solution to remove metal from said metal body.

10. A method, as claimed in claim 1, wherein said treating step comprises contacting said metal body with a second solution to produce a roughened surface on said metal body.

11. A method, as claimed in claim 1, wherein said treating step comprises generating a second coating on said metal body to achieve substantial uniformity throughout said desired portion of said metal body.

12. A method, as claimed in claim 1, wherein said treating step includes electrochemically treating said metal body in a second solution at a predetermined voltage to achieve substantially uniform reflectance throughout said desired portion of said metal body.

13. A method, as claimed in claim 12, wherein said treating step comprises obtaining a first shape of gray associated with said desired portion of said metal body by maintaining contact between said metal body and said second solution for a predetermined time.

14. A method, as claimed in claim 13, wherein said treating step comprises obtaining a second shade of gray that is darker than said first shade of gray and said second shade of gray being produced using a contacting time in said second solution longer than said contacting time in said second solution for achieving said first shade of gray.

15. A method, as claimed in claim 13, wherein said first shade of gray depends upon at least one of the following: the contacting time between said metal body and said second solution, the composition of said metal body, the temperature of said second solution and a concentration of a caustic compound found in said second solution.

16. A method, as claimed in claim 1, further including using said metal body in a lithographic process after said treating step.

17. A method, as claimed in claim 1, wherein said first coating includes an oxide.

18. A method, as claimed in claim wherein the thickness of said first coating is at least about 100 angstroms.

19. A method, as claimed in claim 18, wherein said thickness of said first coating is in the range of about 100 to about 1,000 angstroms.

20. A method, as claimed in claim 1, wherein said pores define a pore density of about at least $1\times10^{10}$ pores/cm$^2$.

21. A method, as claimed in claim 20, wherein said pore density is in the range of about $1\times10^{10}$ to about $1\times10^{11}$ pores/cm$^2$.

22. A method, as claimed in claim 1, wherein said treating step includes removing metal from said metal body and in which said removing during said treating step removes at least about 1,000 times more metal than any metal removed during said preparing step.

23. A metal product made from the following steps in which the thickness of a first coating is at least about 100 angstroms, comprising:

(a) preparing a metal body in a first solution by producing electrochemically said first coating on at least a desired portion thereof, wherein said first coating has a large number of substantially uniformly distributed pores and provides a substantially continuous outer surface on said metal body; and (b) treating said metal body to achieve substantially throughout said desired portion of said metal body a substantially uniform distribution of pits and a substantially matte finish, said treating step including removing substantially all of said first coating from said metal body in a second solution, wherein a substantial number of said pits have a depth of no more than about 3 microns.

24. A metal product, as claimed in claim 23, wherein said metal body comprises aluminum having a substantially uniformed roughened surface after said treating step.

25. A metal product, as claimed in claim 23, wherein said metal body comprises aluminum in which the diffusive reflectance of said metal body is substantially optimized and the spectral reflectance of said metal body is reduced after said treating step.

26. A metal product, as claimed in claim 23, wherein said first coating includes an oxide.

27. A method, as claimed in claim 1, wherein a majority of said pits have a depth of no more than about 3 microns.

28. A method, as claimed in claim 2, wherein said metal body comprises an aluminum alloy designated as 6061 or 6063.

29. A method, as claimed in claim 1, wherein said treating step includes removing substantially all of said first coating from said metal body in a second solution.

30. A product, as claimed in claim 23, wherein a majority of said pits have a depth of no more than about 3 microns.

31. A product, as claimed in claim 23, wherein said metal body comprises an aluminum alloy designated as 6061 and 6063.

32. A product, as claimed in claim 23, wherein said treating step includes, after said preparing step, removing metal from said metal body in a second solution.

33. A method, as claimed in claim 1, wherein said treating step includes the substep of removing substantially all of said first coating by contacting said metal body with alternating electric current in said second solution, which comprises an electrolyte.

34. A product, as claimed in claim 23, wherein said treating step includes the substep of removing substantially all of sad first coating by contacting said metal body with alternating electric current in said second solution, which comprises an electrolyte.

35. A method, as claimed in claim 23, wherein said preparing step includes the substep of producing electrochemically said first coating by anodizing said metal body.

* * * * *